United States Patent [19]

Colleran et al.

[11] Patent Number: 4,943,248

[45] Date of Patent: Jul. 24, 1990

[54] ELECTRICAL TERMINAL FOR BLADED FUSE

[75] Inventors: Stephen A. Colleran, Lisle; Robert J. Gugelmeyer, Aurora; Bill B. Wilson, Montgomery, all of Ill.

[73] Assignee: Molex Incorporated, Lisle, Ill.

[21] Appl. No.: 411,254

[22] Filed: Sep. 25, 1989

Related U.S. Application Data

[63] Continuation of Ser. No. 213,193, Jun. 29, 1988, abandoned.

[51] Int. Cl.[5] ..... H01R 11/22

[52] U.S. Cl. ..... 439/850; 439/621; 439/849

[58] Field of Search ..... 439/851-857, 439/833, 845, 849, 850, 621, 622, 830, 831, 832, 890

[56] References Cited

U.S. PATENT DOCUMENTS

| | | | |
|---|---|---|---|
| 2,767,283 | 10/1956 | Jung | 439/830 |
| 4,451,109 | 5/1984 | Inoue | 439/830 |
| 4,553,808 | 11/1985 | Weidler et al. | 439/830 |
| 4,560,227 | 12/1985 | Bukala | 439/621 |
| 4,693,536 | 9/1987 | Colleran et al. | 439/404 |

FOREIGN PATENT DOCUMENTS

| | | | |
|---|---|---|---|
| 2237064 | 2/1974 | Fed. Rep. of Germany | 439/850 |

*Primary Examiner*—David L. Pirlot

*Attorney, Agent, or Firm*—Louis A. Hecht; Stephen Z. Weiss

[57] ABSTRACT

A terminal is provided for receiving a blade terminal of an automotive fuse. The terminal comprises first and second U-shaped contact arms disposed in spaced relationship to define a blade receiving slot therebetween. As a result, a blade terminal inserted into the blade receiving slot will be contacted on its first side by the first U-shaped contact structure and on its second side by the second U-shaped contact structure. Each U-shaped contact structure is defined by forming the metal material of the terminal about an axis extending parallel to the plane of the metal. Each U-shaped contact structure comprises first and second contact arms and a connecting portion extending therebetween. Each contact arm comprises a generally convex arcuate contact edge extending into the blade receiving slot and generally toward the opposed U-shaped contact structure. Each terminal further comprises bases from which the U-shaped contact structures extend. As a result of this construction, each U-shaped contact structure is pivoted about an axis extending orthogonal to the plane of the metal from which the terminal is formed upon insertion of the blade into the blade receiving slot.

5 Claims, 3 Drawing Sheets

ELECTRICAL TERMINAL FOR BLADED FUSE

This is a file wrapper continuation application of co-pending United States Patent application Serial No. 213,193 filed on June 29, 1988, now abandoned.

BACKGROUND OF THE INVENTION

Many electrical fuses, including the fuses employed in automotive vehicles, comprise a pair of generally blade terminals which are electrically connected to one another. The electrical connection between the blade terminals of the fuse is selected in accordance with the specified current to be carried by the circuit into which the fuse is incorporated. An electrical current level which exceeds the specified level will damage the electrical connection between the blade terminals of the fuse, thereby breaking the circuit and preventing more serious damage to other electrical components. The fuse is removably mounted in the electrical circuit such that the fuse can be removed and replaced if the electrical fuse connection between the blade terminals is broken.

Typically the planar blade terminals of the fuse are disposed in spaced generally coplanar relationship. The blade terminals generally are elongated substantially rectangular structures aligned with their respective long axes generally parallel. One longitudinal end of each blade and the electrical connection therebetween typically is mounted in a nonconductive fuse housing. The opposed longitudinal end of each blade terminal extends from the nonconductive fuse housing for insertion into two separate blade receiving terminals which are mounted in a fuse block or similar structure. Thus, the fuse completes an electrical circuit between the two blade receiving terminals in the fuse block. However, upon damage to the electrical connection in the fuse between the fuse terminal blades, the circuit between the two blade receiving terminals in the fuse block is broken.

The above described bladed fuses are widely used in the automotive industry to protect virtually all of the electrically powered equipment of an automobile, including the headlights, sound systems, dashboard indications, air conditioners and such. The entire electrical system, including the fuses are necessarily subjected to very substantial vibrations and extreme ranges in temperature within the automotive environment. Thus, the blade receiving terminals into which the above described bladed fuses are inserted must achieve the seemingly conflicting objectives of providing for removability in the event of damage to the fuse and providing for a high quality electrical connection through all extreme ranges of vibration and temperature.

The prior art terminals for receiving the blade terminals of a fuse typically have been stamped and formed from strips of metal to define opposed terminal contact arms for mechanically and electrically engaging opposed sides of the blade terminals of the fuse. More particularly, the strips of metal have been formed in the prior art terminals such that the major planar surface of the formed metal strip is in face to face contact with one of the planar surfaces of the bladed fuse terminal. This prior art construction is intended to maximize the area of contact between the blade terminal of the fuse and the blade receiving terminal. To improve the contact pressure, the prior art blade receiving terminals have been formed such that the opposed contact arms must be biased away from one another by the insertion of the bladed fuse terminals therebetween.

An example of a typical prior art bladed fuse receiving terminal is shown in U.S. Pat. No. 4,460,239 which issued to Inoue on July 17, 1984. It will be noted that the terminals shown in U.S. Pat. No. 4,460,239 each are formed from a single strip of metal having major length and width dimensions defining opposed major surfaces and having a minor thickness dimension which extends between the major surfaces. A blade receiving slot is defined between two opposed major surfaces of the formed metal strip. One strip of metal defining the blade receiving slot must be resiliently deflected about an axis disposed in or parallel to the plane of the metal to receive the fuse blade in the slot. The resiliency of the metal is then intended to exert a force against the fuse blade terminal mounted in the slot. The formed fuse blade receiving terminal of U.S. Pat. No. 4,460,239 further includes a pair of slots for mounting the terminal to a bussing strip.

A similar prior art fuse blade receiving terminal is shown in U.S. Pat. No. 4,451,109 which also issued to Inoue. The terminal of U.S. Pat. No. 4,451,109 is formed from a single strip of metal and is provided with a pair of slots for mounting the terminal to a bussing strip. A terminal contact arm is bent around an axis disposed in or parallel to the plane of the metal, and is angularly directed toward the bussing strip engaged in the pair of slots. Thus, the terminal shown in U.S. Pat. No. 4,451,109 is operative to urge a blade terminal of a fuse mounted therein against the bussing strip.

Other prior art using fuse blade receiving terminals defined by strips of metal bent around an axis disposed in or parallel to the plane of the metal material are shown in U.S. Pat. No. 4,391,485 which issued to Urani on July 5, 1983; U.S. Pat. No. 4,466,683 which issued to Ballarini on Aug. 21, 1984; U.S. Pat. No. 4,456,274 which issued to Olivera on Dec. 3, 1985 and U.S. Pat. No. 4,560,227 which issued to Bukala on Dec. 24, 1985.

A particularly effective electrical terminal for applications other than fuses is shown in U.S. Pat. No. 4,693,536 which issued to Colleran et al. on Sept. 15, 1987 and which is assigned to the assignee of the subject invention. The terminal shown in U.S. Pat. No. 4,693,536 includes insulation displacement terminal structure at one end and a pin or spade receiving terminal structure at the opposed end. The pin or spade receiving end of the terminal shown in U.S. Pat. No. 4,693,536 is formed from a metallic strip bent about an axis extending parallel to the plane of the metal to define a generally U-shape having a pair of parallel arms and a connecting portion. A pin or spade receiving slot of uniform width along its length extends through the connecting portion of the U-shape and longitudinally through each arm. Thus, the slot shown in U.S. Pat. No. 4,693,536 effectively defines a pair of opposed U-shaped terminal portions which are spaced equal distances from one another along the entire length of the uniform width slot. A plurality of such terminals are mounted in a housing constructed to receive spade or pin terminals at one end and insulated conductors at the opposed end. The terminals are aligned in the housing such that the respective arms of the U-shaped structures lie in two opposed generally parallel planes. The slots in the array of terminals define spaced apart parallel planes, with the number of such planes being equal to the number of terminals. Thus, for example, in an array of two such terminals, the first arms of a first terminal would lie in the same plane as the first arms of a second terminal. Similarly, the second arms of the first terminal would lie in the same plane as the second arms of the second terminal. The slots formed in the two terminals would define two spaced apart generally parallel planes. Although the pin or spade receiving portion of the terminal shown in U.S. Pat. No. 4,693,536 provides desirable electrical connection for many purposes, this terminal is not designed for receiving a blade fuse in the high vibration environments encountered in automotive electronics and does not provide any specific teaching directed to the above described automotive fuses.

In view of the above, it is an object of the subject invention to provide an improved terminal for mating with the blade terminal of a fuse.

It is another object of the subject invention to provide an electrical terminal for achieving superior electrical and mechanical connection to a bladed fuse terminal in a high vibration automotive environment.

An additional object of the subject invention is to provide a plurality of terminals for receiving the blades of an automotive fuse.

Still a further object of the subject invention is to provide a blade receiving terminal for mounting to a printed circuit board and for securely but removably receiving a blade terminal of a fuse.

SUMMARY OF THE INVENTION

The subject invention is directed to a unitarily stamped and formed metallic terminal for achieving excellent mechanical and electrical connection to a blade terminal, such as the blade terminal of an automotive fuse used in a high vibration environment.

The subject terminal comprises a pair of spaced apart U-shaped contact structures defining a blade receiving slot between the U-shaped contact structures. More particularly, each U-shaped contact structure comprises first and second spaced apart generally parallel contact arms and a connecting strip extending unitarily between the first and second contact arms. Each contact arm comprises a pair of opposed generally parallel major surfaces and a pair of opposed minor side edges. Each U-shaped contact structure is formed such that major surfaces of the first and second contact arms thereof are disposed in opposed facing relationship. This configuration is achieved by forming the metallic material of the U-shaped contact structure about an axis that is parallel to or within the initial plane of the metal.

The terminal further comprises first and second bases for locking engagement with a housing, such as a plastic fuse block housing. The bases are unitary with the U-shaped contact structures and are disposed at locations thereon remote from the connecting strips of each U-shaped contact structure. More particularly, the first base is unitary with the two first contact arms, while the second base is unitary with the two second contact arms. The bases may be generally planar and disposed in generally parallel spaced apart relationship. At least one of the first and second bases may be provided with means for lockingly engaging the terminal in a nonconductive housing, such as a fuse block housing. For example, the first and second bases may be provided with cantilevered locking tangs extending angularly from each base. One base may be provided with a solder tail to permit mounting of the fuse receiving terminal directly to a printed circuit board. However, other termination means, such as crimp-on structures may be provided instead of a solder tail.

The two U-shaped contact structures are disposed such that a fuse blade inserted therebetween will contact the minor side edges of the two U-shaped contact structures. More particularly, the first contact arms may be disposed in generally coplanar relationship to contact substantially opposite locations on a fuse blade. Similarly, the second contact arms may also be disposed generally in coplanar relationship to contact opposite locations on the same fuse blade.

As noted above, a fuse blade receiving slot is defined between the two U-shaped contact structures. The width of the blade receiving slot is selected to ensure that the insertion of the fuse blade therein biases the two U-shaped contact structures away from one another. However, this is substantially unlike the prior art fuse terminals which place the fuse blade between the arms of a single U-shaped structure to deflect the arms about an axis within or parallel to the plane of the metal. Rather, the subject terminal requires each U-shaped structure to be biased about an axis extending orthogonal to the plane of the metal from which the terminal is formed. This substantial difference results in significantly greater contact pressure against the fuse blade.

In the preferred embodiment, as explained further below, the side edges of the U-shaped contact structures that face one another are configured to define generally arcuate ramped camming contact edges. More particularly, each contact arm may be provided with a generally convex arcuate ramped contact edge extending into the blade receiving slot. With this configuration, a high quality wiping electrical connection is achieved with contact forces gradually increasing as the fuse blade terminal is inserted into the slot. Consequently, each fuse blade will be securely mechanically and electrically engaged between two pairs of opposed convex arcuate contact edges.

The subject invention may further comprise a pair of terminals as described herein. The terminals in each pair may be appropriately disposed such that the blade receiving slots are substantially in a common plane. Thus, the blade receiving slots of the two terminals can receive a pair of spaced apart but generally coplanar blade terminals of a standard automotive fuse. With this construction, the U-shaped contact structures in each terminal will be biased away from one another as the double bladed fuse is urged into the aligned slots. In this embodiment, each blade of the automotive fuse will be securely electrically and mechanically engaged by four contact edges, with two spaced apart contact edges on each side of each blade. Furthermore, the contact edges on one side of each blade will be generally aligned with but opposite to the contact locations on the other side of the blade to ensure an extremely tight gripping engagement of the blade and enhanced electrical connection in the high vibration automotive environment.

DETAILED DESCRIPTION OF THE PREFERRED EMBODIMENT

Figure 1:
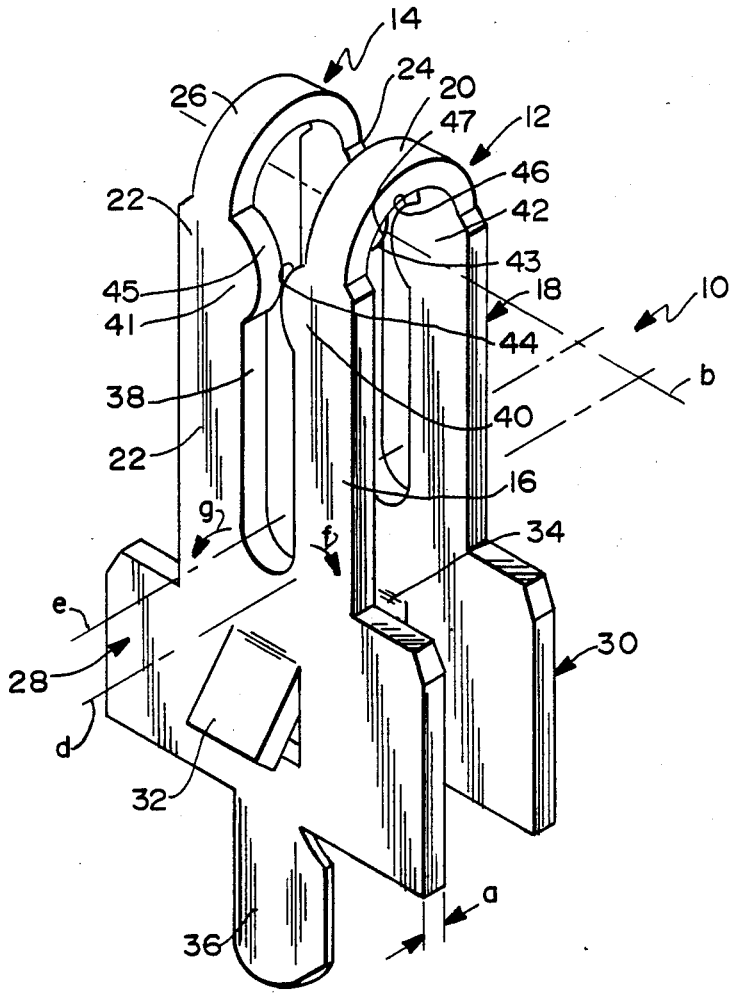
FIG. 1 is a perspective view of the terminal of the subject invention.
Figure 2:
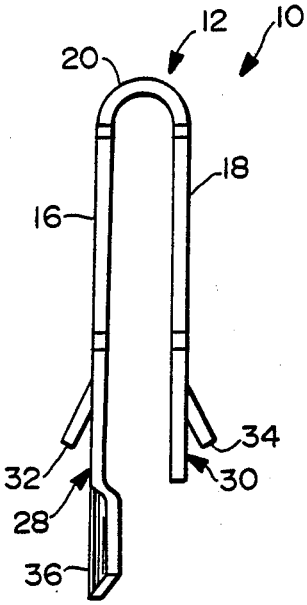
FIG. 2 is a side elevational view of the terminal shown in FIG. 1.

The bladed fuse receiving terminal of the subject invention is identified generally by the numeral 10 in FIG. 1. The terminal 10 is formed from a phosphor bronze alloy having a thickness "a" of approximately 0.38 mm. ± 0.013 mm. The terminal 10 is stamped and formed into the configuration shown in FIG. 1 to define a pair of substantially identical parallel spaced apart U-shaped contact structures 12 and 14. More particularly, the U-shaped contact structure 12 comprises first and second generally parallel spaced apart contact arms 16 and 18 and a connecting strip 20 extending unitarily between the contact arms 16 and 18. Similarly, the U-shaped contact structure 14 comprises first and second spaced apart generally parallel contact arms 22 and 24 and a connecting strip 26 extending unitarily therebetween. The U-shaped configuration of the contact structures 12 and 14 is obtained by forming the metallic material of the terminal 10 about an axis "b" extending parallel to the major surfaces of the metallic material of terminal 10.

The terminal 10 further comprises first and second bases 28 and 30 for mounting the terminal 10 in a nonconductive housing as explained further below. The first and second bases 28 and 30 are disposed in spaced apart generally parallel relationship to one another. Additionally, the first contact arms 16 and 22 extend unitarily from the first base 28, while the second contact arms 18 and 24 extend unitarily from the second base 30. The actual configuration of each base 28 and 30 is dependent upon the particular construction of the nonconductive housing into which the terminal 10 is to be mounted. However, in most instances, the bases 28 and 30 will be generally planar as depicted in the Figures hereto. The bases 28 and 30 further comprise cantilevered deflectable locking tangs 32 and 34 extending therefrom. The tangs 32 and 34 are disposed to lockingly engage corresponding structures on the nonconductive housing into which the terminal 10 is inserted.

The terminal 10 further comprises a solder tail 36 extending unitarily from the first base 28 thereof. The terminal 10 will be mounted in a nonconductive housing such that the solder tail 36 thereof extends from one side of the housing. As a result, the solder tail 36 can be extended through an aperture in a printed circuit board to be electrically connected to an electrically conductive lead that is printed or otherwise disposed on the circuit board. Alternatively, however, the terminal 10 may be provided with a crimp-on contact portion instead of the solder tail 36. The solder tail 36 is depicted as having its longitudinal axis extending generally within the plane of the first base 28 and generally parallel to the first contact arms 16 and 22. However, it is to be understood that the solder tail 36, or other such connecting structure, could be disposed at an angle to the alignment depicted in FIG. 1. For example, a right angle solder tail or crimp-on connecting structure could be provided in lieu of the solder tail 36 depicted in the Figures hereto.

Figure 3:
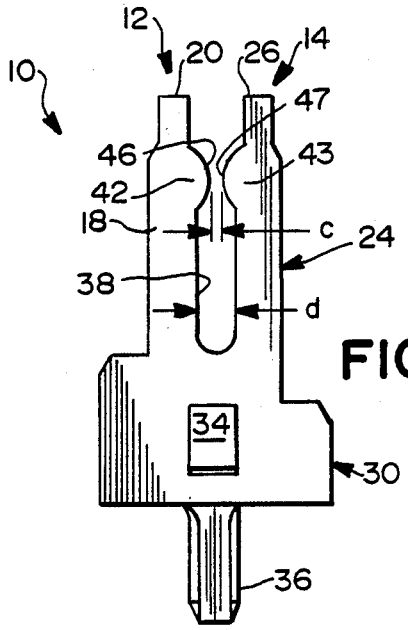
FIG. 3 is a front elevational view of the terminal.

As shown most clearly in FIGS. 1 and 3, the U-shaped contact structures 12 and 14 are disposed in spaced apart generally parallel relationship to define a blade receiving slot 38 therebetween. The minimum width of the blade receiving slot 38, as indicated by dimension "c" in FIG. 3 is defined by contacts 40 and 41 on the respective first contact arms 16 and 22 and by the contacts 42 and 43 on the second respective contact arms 18 and 24. The contacts 40–43 lie generally in the same plane as adjacent portions of the corresponding contact arms 16, 22, 18 and 24. However, the contacts 40–43 are defined by convex arcuate contact edges 44–47 respectively which are in opposed facing relationship. The distance "c" separating the convex arcuate contact edges 44 and 45 on the first contact arms 16 and 22 and separating the convex arcuate contact edges 46 and 47 on the second contact arms 18 and 24 is selected to be less than the thickness of the fuse blade terminal to be inserted into the blade receiving slot 38. However, the distance "d[ separating the first contact arms 16 and 22 or the second contact arms 18 and 24 at locations spaced from the convex arcuate contacts 40–43 preferably exceeds the thickness of the fuse blade terminal to be inserted in the blade receiving slot 38.

Figure 4:
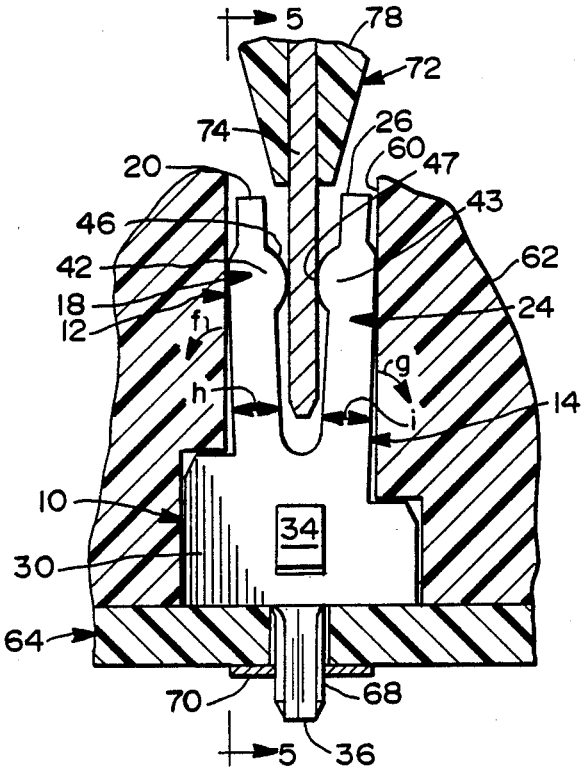
FIG. 4 is a front elevational view similar to FIG. 3 but showing the terminal mounted in a housing and to a printed circuit board and further showing a fuse engaged in the terminal.

As shown in FIG. 4, the terminal 10 is mounted in a terminal receiving cavity 60 of a nonconductive housing 62. In particular, the terminal 10 is mounted in the housing 62 such that the solder tail 36 thereof extends away from one peripheral portion of the housing 62. Thus, the terminal 10 and the housing 62 can be mounted to a printed circuit board 64 having a through hole 68 extending entirely therethrough for receiving the solder tail 36. The solder tail 36 may then be electrically and mechanically connected to a conductive lead 70 printed on the circuit board 64.

Figure 5:
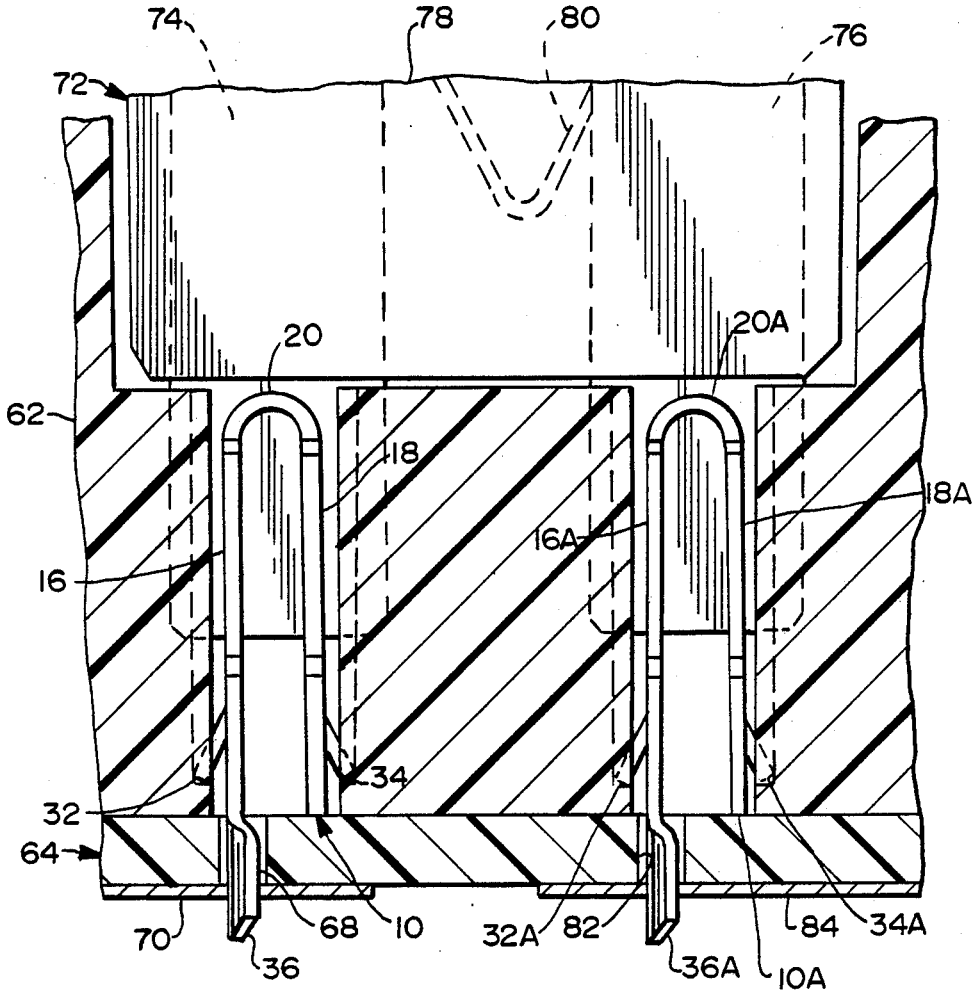
FIG. 5 is a perspective view showing a pair of terminals having a fuse mounted therein.

With reference to FIG. 5, the terminal 10 is employed with a second substantially identical terminal 10A which also is mounted in the housing 62. In particular, the terminals 10 and 10A are disposed in the housing 62 such that the blade receiving slots thereof define a substantially common plane. Thus, returning to FIG. 4, the terminal 10A and its associated blade receiving slot is directly behind and substantially in register with the terminal 10 and blade receiving slot 38 depicted in FIG. 4.

The fuse 72 shown in FIGS. 4 and 5 is of the type typically used in automotive applications and comprises a pair of spaced apart blade terminals 74 and 76 extending from a nonconductive housing 78. The blade terminals 74 and 76 each are substantially planar and lie substantially in the same plane. Additionally, the blade terminals 74 and 76 are disposed with respect to the housing 78 such that portions of each blade terminal 74 and 76 extend from the housing, while the remaining portions are disposed within the housing 78. The fuse 72 further comprises a fuse wire 80 extending between and connecting portions of the terminal blades 74 and 76 that are disposed within the nonconductive housing 78. The fuse wire 80 provides an electrical connection between the terminals 74 and 76. However, the fuse 72 is operative for a selected current level. If the specified current level is exceeded, the fuse wire 80 will break, thereby preventing a transmission of electrical current between the terminal blades 74 and 76.

The terminal housing 62 is mounted to the printed circuit board 64 such that the solder tail 36 extends through the through hole 68 therein and such that the solder tail 36A of terminal 10A extends through a second through hole 82 in the printed circuit board 64. As noted above, the solder tail 36 is electrically and mechanically connected to a conductive lead 70 on the printed circuit board, while the solder tail 36A is connected to a second conductive lead 84 on printed circuit board 64. As a result, the fuse 72 provides for electrical connection between the conductive leads 70 and 84 of the printed circuit board 64.

As noted above, the electrical circuitry of automobiles frequently is subjected to extreme vibrations and extreme ranges in temperature. Such vibrations and temperature variations can adversely affect the quality of the electrical connection of terminals to a bladed fuse. However, the terminals 10 and 10A shown and described herein ensure superior electrical and mechanical connection to the fuse 72 through virtually all ranges of vibration and temperature that are likely to be encountered. In particular, as shown more clearly in FIG. 4, the insertion of the fuse 72 into the fuse housing 62 urges the fuse blade 74 into the blade receiving slot 38 between the U-shaped contact structures 12 and 14. The fuse blade 74 is simultaneously urged into a camming wiping engagement with the convex arcuate contact edges 44–47. Thus, the arcuate convex contact edges 44–47 function as ramps or cams which cause the respective U-shaped contact structures 12 and 14 to be biased away from one another. Simultaneously, a corresponding biasing of the U-shaped structures of terminal 10A will occur in response to camming engagement with fuse blade 76. By virtue of the above described unique construction of the terminals 10 and 10A, the U-shaped contact arm structures 12 and 14 will be urged away from one another, with pivoting actions occurring substantially along the axes "d" and "e" and in the direction of arrows "f" and "g" shown in FIG. 1.

It will be appreciated that the rotation of the U-shaped terminal structures caused by the insertion of the fuse 72 and indicated generally by the arrows "f" and "g", will cause the U-shaped contact structures 12 and 14 to deflect with respect to a major thickness dimension thereof. In particular, as shown most clearly in FIG. 4, the width "h" and "i" of each contact arm 16, 18 and 22, 24 respectively is several times greater than the thickness "a" of the metal material from which the terminal 10 is formed. As a result, substantial residual biasing forces will be exerted against the blade terminals 74 and 76 by the U-shaped contact structures of the respective terminals 10 and 10A.

The camming interaction between the blade terminals 74, 76 and the respective convex arcuate contact edges 44–47 enables a fairly easy insertion of the fuse 72 into the terminals 10 and 10A, yet also achieves the desirable wiping contact and the gradual development of substantial inwardly directed forces against the terminal blades 74 and 76. Upon complete insertion of the fuse 72 into the terminals 10 and 10A, as shown in FIGS. 4 and 5, the residual forces exerted by the terminals 10 and 10A against the blade terminals 74 and 76 result in superior mechanical and electrical connection. It should also be noted that a terminal having substantially parallel and/or planar contact edges defining the blade receiving slot could not both achieve the relatively easy insertion of the fuse into the blade receiving slot and simultaneously develop the substantial contact forces enabled with the terminals 10 and 10A as described and shown herein. It should further be noted that the contact forces against the blade terminals 74 and 76 by the blade receiving terminals 10 and 10A is much greater than the forces enabled by the standard fuse receiving terminal which develops contact forces by deflecting contact arms about axes lying within the plane of the metal in the terminals, rather than about axes extending orthogonal thereto. Although the terminals 10 and 10A described herein achieve a smaller contact surface, the much greater contact forces against the blade terminals of the fuse result in a much more effective mechanical and electrical connection for the high vibration, temperature-variable environment in which an automotive fuse is employed.

In summary, a blade receiving terminal is provided for receiving the blade terminal of an automotive fuse. The terminal comprises first and second U-shaped contact structures with a blade receiving slot therebetween for achieving mechanical and electrical contact with the opposed first and second sides respectively of a blade terminal. The first and second U-shaped contact structures are formed by bending the metal material of the terminal about an axis extending parallel to the plane of the metal. Each U-shaped contact structure comprises first and second contact arms, with the first contact arms being unitary with a first base and the second contact arms being unitary with a second base. The bases of the terminal are securely mountable in a housing. A solder tail or other such connector means may extend from one of the bases. Each contact arm comprises a generally convex arcuate contact edge extending into the blade receiving slot between the contact structures and toward the opposed U-shaped contact structure. The spacing between opposed convex arcuate contact edges is less than the thickness of the blade to be inserted into the terminal. Thus, the movement of the blade into the blade receiving slot of the terminal causes a camming interaction between the blade terminal and the convex arcuate contact edges. As a result, the respective U-shaped contact structures will be urged away from one another about an axis extending generally orthogonal to the plane of the metal from which the terminal is formed. Substantial residual contact forces are developed which achieve superior electrical and mechanical connection to the blade terminal of the fuse. The terminals of the subject invention may be employed in pairs such that the terminal receiving slots thereof lie generally in a common plane.

While the invention has been described with respect to a preferred embodiment, it is apparent that various changes can be made without departing from the scope of the invention as defined by the appended claims.

We claim:

1. An electrical connector for connecting an automotive fuse to another circuit member, said automotive fuse being of the type including an elongate dielectric fuse housing having a body portion with an edge and a pair of coplanarly aligned, spaced-apart, flat metallic contact blades extending from said edge, said electrical connector comprising:

a dielectric connector housing including a front end with at least one elongate opening and an opposed rear end with at least one pair of spaced and aligned openings, a fuse-receiving slot extending rearwardly from said elongate opening in the front end to a rear slot surface disposed intermediate the front end and the rear end of the housing, and at least one pair of spaced-apart terminal receiving cavities extending forwardly from said pair of rear end openings to said rear slot surface and communicating with said fuse-receiving slot; and at least one pair of terminals stamped and formed from a unitary metal strip having a substantially uniform thickness, each terminal including first and second spaced apart bases and a pair of adjacent spaced apart U-shaped contact structures extending between and interconnecting the first and second bases and defining a blade-receiving contact slot therebetween, each said U-shaped contact structure including a first contact arm extending from said first base and a second contact arm extending from said second base and a connecting strip extending therebetween, said first contact arms and said second contact arms each being spaced apart a distance substantially larger than said strip thickness and having a generally convex arcuate contact edge portion extending into said blade-receiving contact slot such that the distance between opposing arcuate edge portions of said U-shaped contact structures is less than the thickness of a said flat contact blade of an automotive fuse, each terminal being mounted in one of said terminal-receiving cavities so that the blade-receiving contact slot is aligned with the fuse-receiving slot and the bases are disposed adjacent the rear end of the housing, each terminal further including a second contact portion extending from one of said bases for electrically engaging said another circuit member, whereby, insertion of an automotive fuse into said fuse-receiving slot so that the edge of the fuse housing generally abuts said rear slot surface and the flat blade contact portions are received in the blade receiving contact slots of the terminals causes the U-shaped contact structures of each terminal to be deflected away from one another generating four vibration-resistant points of electrical contact between each terminal and each fuse blade to securely, electrically and mechanically engage the automotive fuse in said connector.

2. An electrical connector as in claim 1, wherein said second contact portion of each terminal electrically engages a conductive lead.

3. An electrical connector as in claim 1, further including means for lockably mounting the terminals in the terminal-receiving cavities.

4. An electric connector as in claim 1, wherein said another circuit member includes a printed circuit board having conductive regions defined thereon and the second contact portion on each terminal electrically engages a conductive region on said printed circuit board.

5. An electrical connector as in claim 4, wherein said second contact portion comprises a solder tail.

* * * * *